United States Patent [19]

Parsonage et al.

[11] 3,995,837

[45] Dec. 7, 1976

[54] APPARATUS FOR MIXING FOUNDRY MATERIALS

[75] Inventors: Raymond Arthur Parsonage, West Bromwich; Harold Higgs, Wolverhampton, both of England

[73] Assignee: Fordath Limited, West Bromwich, England

[22] Filed: July 11, 1975

[21] Appl. No.: 595,042

[52] U.S. Cl. ..... 259/8; 259/161; 259/165; 259/178 R

[51] Int. Cl.[2] ..... B01F 7/24

[58] Field of Search ..... 259/7, 5, 6, 37, 40, 259/42, 111, 161, DIG. 12, DIG. 4, DIG. 34, 178 R, 178 A, 8, 165

[56] References Cited

UNITED STATES PATENTS

| | | | |
|---|---|---|---|
| 33,850 | 12/1861 | Paddock | 259/DIG. 34 |
| 337,634 | 3/1886 | Tate | 259/DIG. 34 |
| 3,779,519 | 12/1973 | Anderson et al. | 259/161 |

*Primary Examiner*—Richard E. Aegerter
*Assistant Examiner*—Willis Little
*Attorney, Agent, or Firm*—Klarquist, Sparkman, Campbell, Leigh, Hall & Whinston

[57] ABSTRACT

A final mixing chamber for mixing together previously separately prepared mixtures of foundry sand/binder and foundry sand/catalyst which are delivered to the upper end of the final mixing chamber having a discharge aperture in its lower end and a vertical rotatable shaft extending centrally through the chamber with blades fixed thereto. Some of the blades extend radially from the shaft and are made up of mixer blades which direct material downwardly and deflector blades which deflect material upwardly, while the remaining blades are scraper blades which are attached between adjacent ones of the other blades at their extremities so as to scrape the internal surface of the chamber.

4 Claims, 3 Drawing Figures

FIG. 3

APPARATUS FOR MIXING FOUNDRY MATERIALS

BACKGROUND OF THE INVENTION

1. Field of the Invention

This invention relates to improvements in and modifications of the apparatus described in our prior application Ser. No. 425,231 filed Dec. 17th, 1973, now U.S. Pat. No. 3,934,858 granted Jan. 27, 1976 of which the present application is a continuation in part. In such prior application is disclosed a method and apparatus for the mixing together of foundry sand and binder to provide a mixture for making moulds and cross for use in casting operations.

2. Description of the Prior Art

The method and apparatus of the aforesaid application is particularly concerned with the provision of a mixture in which sand is mixed with a curable binder, which may be synthetic resin, and a catalyst which accelerates the curing and setting of the binder so as to speed up production of castings by cutting down on the time taken for the setting of moulds and cores, and the apparatus described is particularly designed for use with rapid cold setting binders wherein curing and setting of the mixture takes place very rapidly in the cold.

The apparatus disclosed in the aforesaid application comprises a pair of mixer and conveyor units, one for producing a sand/binder mixture and one for producing a sand/catalyst mixture, a final mixing chamber having a mixture discharge aperture at its lower end and having said mixer and conveyor units discharging into its upper end, a rotatably driven shaft extending downwardly and centrally through said final mixing chamber and sets of blades fixed to said shaft at spaced positions therealong some of said blades being mixer blades which are inclined so as to deflect material downwardly and some of said blades being deflector blades which are positioned in an upwardly inclined direction so as to deflect portions of the downwardly descending mixture in an upwards direction.

SUMMARY OF THE INVENTION

The present invention provides improvements and modifications in the abovementioned arrangement.

According to this invention, in addition to the mixer blades and deflector blades of the aforesaid prior Application there are provided scraper blades each of which is shaped and arranged so as to move over the internal surface of the final mixing chamber to provide a scraping action to prevent build up of material on said surface and also to deflect material in a generally radially inwards direction in relation to the rotatably driven shaft.

The invention is illustrated by way of example in the accompanying drawings wherein:

DESCRIPTION OF PREFERRED EMBODIMENT

Figure 1:
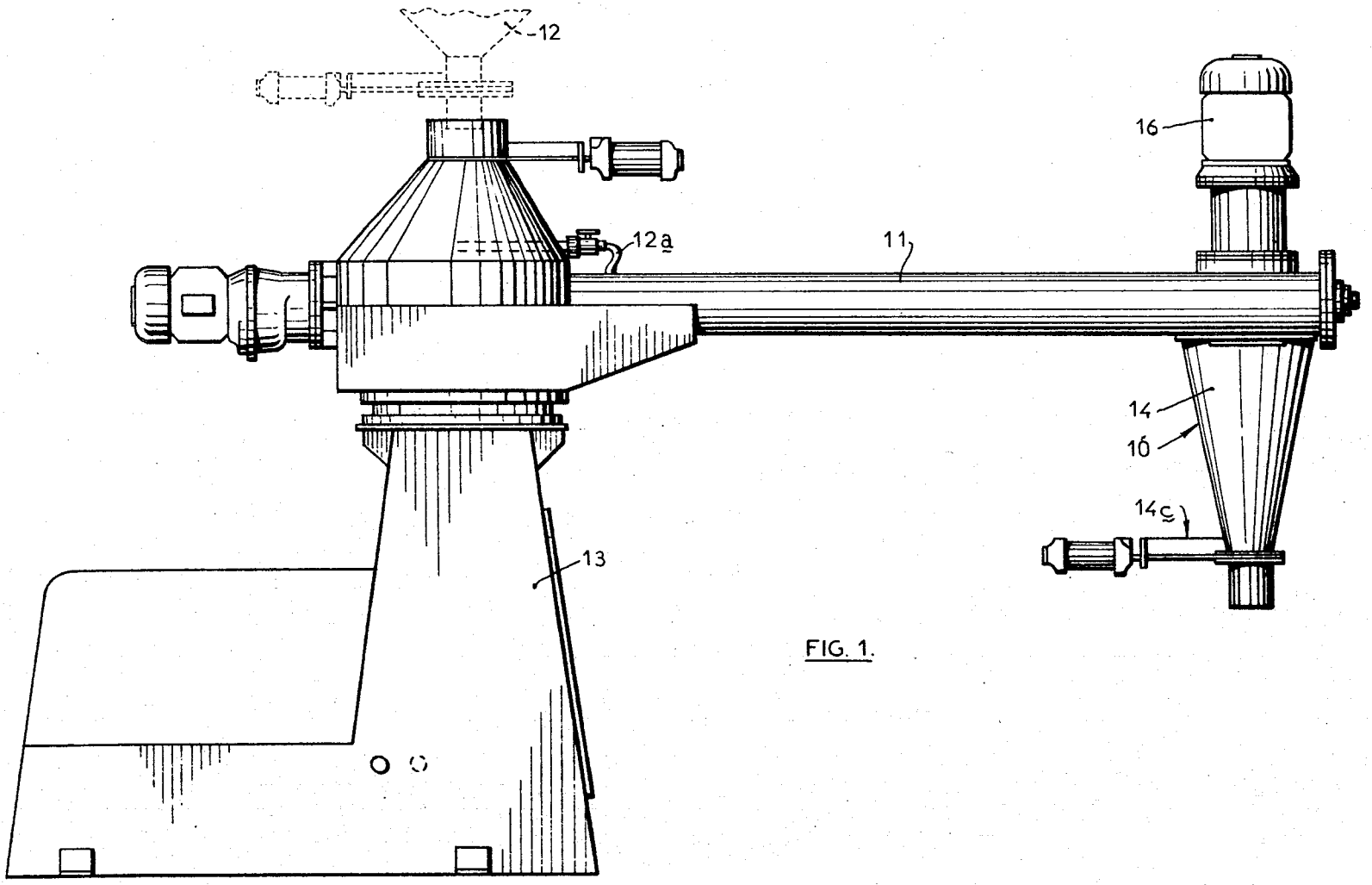
FIG. 1 is a side elevation of a complete apparatus for mixing foundry sand and binder.

With reference to FIG. 1, with the exception of the final mixing chamber, generally indicated by reference numeral 10, the remainder of the apparatus is of generally known construction and is hereinafter described briefly as being one form of apparatus for preparing a separate sand/binder mixture and a separate sand/catalyst mixture and conveying said mixtures to the final mixing chamber.

Figure 2:
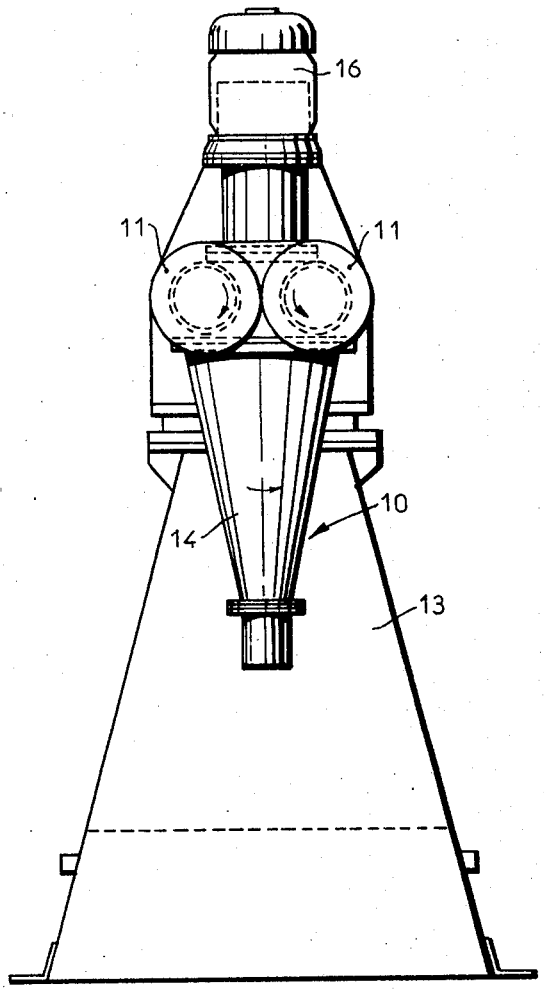
FIG. 2 is an end view from the right of FIG. 1.

As shown in FIGS. 1 and 2, there are two screw conveyor type mixer units of known form indicated at 11 and disposed in side by side relationship and these are fed with sand from hoppers, indicated at 12, and measured quantities of binder in the one case and catalyst in the other case are introduced into the screw conveyor units 12*a* so that mixing of the sand/binder and sand/catalyst mixtures takes place during the conveying of the mixtures along the conveyor tubes to the discharge ends where the two separate mixtures are discharged into the final mixing chamber 10. Also in known manner, the mixer conveyor units 11 are supported rotatably upon a pedestal 13 which houses ancillary parts of the apparatus such as the pumps for binder and catalyst. A detailed description of this part of the apparatus is not considered necessary as it will be known to those skilled in the art and is given by way of example only.

Figure 3:
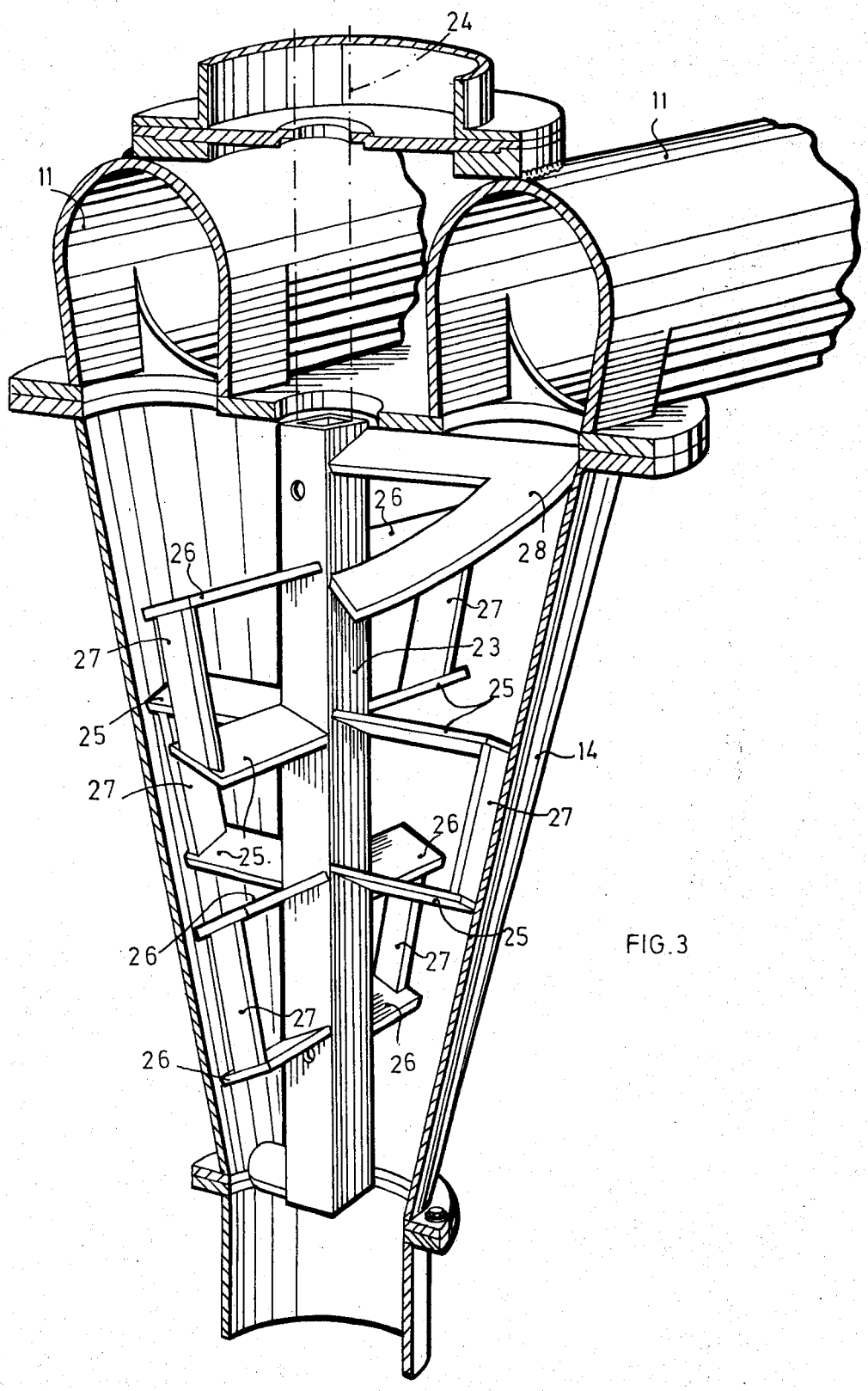
FIG. 3 is a cut-away perspective view of the final mixing chamber.

Referring to FIG. 3 the two mixer conveyor units 11 deliver the sand/binder and sand/catalyst mixtures into the upper end of the final mixing chamber 14 which is of inverted frusto-conical form and which has the rotatable shaft 23 extending downwardly therethrough and coaxial with the axis of the chamber 14. A drive shaft 24 is connected to the shaft 23 and this extends upwardly to be driven from the electric motor 16 as shown in FIG. 1, the direction of rotation of the shaft being indicated by the arrow in FIG. 3.

The blades which are generally of rectangular shape are attached to the central shaft 23 and it will be observed that these blades are of two forms, there being blades 25 which are inclined downwardly in respect of the direction of rotation of the shaft and are known as "deflector"blades which deflect portions of the downwardly descending materials in an upwards direction against the general downwards flow of material and further blades 26 which are inclined upwardly in relation to the direction of rotation and constitute the "mixer" blades which direct material in a downwards direction.

In addition there are provided the further scraper blades 27 each of which is also of generally rectangular form and the scraper blades are connected between the outer ends of pairs of the blades 25 and 26 so that in the example shown there are three sets of scraper blades 27 disposed along the length of the shaft 23 and there being two scraper blades in each set and arranged at diametrically opposed positions. The scraper blades 27 are arranged close to the internal surface of the final mixing chamber 14 and with their axes substantially parallel to this internal surface so that the blades traverse the internal surface and act as scraper blades to prevent any build up of material on the internal surface of the chamber 14. These blades 27 also act upon the material within the chamber 14 to deflect portions thereof in the radially inwards direction so that in combination with the deflector blades 25 they provide a generally turbulent mixing action in which portions of the material are deflected in a radially inwards and also an upwards direction.

A further and different from of scraper blade 28 is provided at the upper end of the shaft 23 to traverse the wall of the chamber 14 at the upper part thereof, and also to traverse the underside of the discharge openings from the mixer conveyor units.

The above described arrangement is designed to promote a very rapid and intimate mixing of the sand, binder and catalyst in the relatively short length of the final mixing chamber. For example, it is envisaged that the speed of rotation of the shaft 23 would be something of the order of 720 r.p.m. as compared with the speed of rotation of the screw conveyor shafts in the mixer conveyors 11 which would be something of the order of 85 r.p.m.

At the lower end of the final mixing chamber 14 there is provided a pneumatically operated sand gate of known form which is not shown in FIG. 3 but which is shown generally at 14*c* in FIG. 1. This gate is for the purpose of providing an initial build-up within the chamber 14 at the commencement of an operation and is opened after a very short period of time to allow discharge of the mixture to commence into moulds and core boxes arranged below. It is important that the chamber 14 should be cleared of any residual sand mixture, upon shutting down, as rapidly as possible to prevent any left-over mixture from setting inside the chamber. It is an advantageous feature of the form of this apparatus that it permits a particularly efficient and rapid cleaning or purging operation to be performed as is mentioned in our prior Application as aforesaid.

Preferably, the chamber 14 is made in two parts hinged or clamped together about a line extending axially down one side of the cone so that the parts of the cone can be separated and swung apart for the purpose of periodic cleaning.

An important practical advantage of the apparatus is its capability of continuous operation to fill a number of moulds or core boxes one after another when working with the aforementioned rapid cold setting binders. The combination of mixer blades deflector blades and scraper blades and their action as above described produces thorough mixing in rapid time whilst also propelling the mixture at high speed downwardly through the final mixing chamber 14. The mixture may be discharged directly into moulds and core boxes. In appropriate cases or if required may be used in conjunction with a conventional form of core blower with the mixture being discharged from chamber 14 direct to the blowing chamber of the core blower.

However, the apparatus is also capable of being adapted to produce batches of mixtures when required. This can be done in one way by providing automatic time control on the primary mixer conveyor units 11 in combination with automatic time control for the cleaning and purging operation.

We claim:

1. Apparatus for mixing foundry sand and rapid setting binder comprising means for preparing a separate sand/binder mixture and a separate sand/catalyst mixture, a vertical mixing chamber, and means for conveying said mixtures separately into the upper end of said mixing chamber having a discharge aperture at its lower end and a rotatable shaft extending downwardly and centrally through the chamber, mixing means contained within the mixing chamber for mixing the two mixtures together as they fall through said mixing chamber including radially extending blades on said shaft which are spaced longitudinally along said shaft, some of said radial blades being mixer blades said mixer blades being oriented to direct the mixture material downwardly and some being deflector blades said deflector blades being oriented to deflect material upwardly, and also including longitudinal scraper blades each of which is supported by said shaft and extends longitudinally along said shaft so as to move over the internal surface of the mixing chamber to provide a scraping action to prevent build up of material on said surface, said scraper blades being spaced apart longitudinally along said and oriented to deflect material in a generally radially inwards direction in relation to the rotatably driven shaft to which the blades are attached said mixer and deflector blades being arranged on said shaft in pairs of longitudinally spaced blades with one blade directly below another, there being one of said scraper blades extending between and attached to the two blades of each pair at the outer extremities thereof.

2. Apparatus according to claim 1 wherein each scraper blade has a length corresponding to the spacing distance between the two blades of the pair of blades to which said scraper blade is attached.

3. Apparatus according to claim 2 wherein the blades are each of generally rectangular form.

4. Apparatus for mixing foundry sand and rapid setting binder comprising first mixer and conveyor means for a sand/binder mixture, second mixer and conveyor means for a sand/catalyst mixture, a vertically disposed downwardly tapering frustoconical mixing chamber having an inlet at its upper end communicating with said first and second mixer and conveyor means and a discharge opening at its lower end, the mixing chamber also having an upright rotatably driven shaft extending centrally therethrough, a plurality of radial blades being provided in pairs extending from said shaft, the blades of each pair being provided vertically one above the other, the blades comprising mixer blades inclined downwardly as considered in the direction of rotation of the shaft and deflector blades inclined upwardly as considered in the direction of rotation of the shaft, a plurality of scraper blades also being provided and being adapted to contact and scrape clean the surface of the final mixing chamber, each of said pairs of blades being joined together at their radially outer ends by one scraper blade which extends between but not beyond the blades of said pair, and the scraper blades being inclined inwardly as considered in the direction of rotation of the shaft.

* * * * *

UNITED STATES PATENT OFFICE

CERTIFICATE OF CORRECTION

PATENT NO. : 3,995,837
DATED : December 7, 1976
INVENTOR(S) : RAYMOND ARTHUR PARSONAGE and HAROLD HIGGS It is certified that error appears in the above-identified patent and that said Letters Patent are hereby corrected as shown below:

Column 1, Line 14: "cross" should be --cores--;

Column 4, Line 20: after "said" insert --shaft--

Signed and Sealed this Fifteenth Day of February 1977

[SEAL]

*Attest:*

RUTH C. MASON
*Attesting Officer*

C. MARSHALL DANN
*Commissioner of Patents and Trademarks*